US005877734A

United States Patent [19]

Amemiya

[11] Patent Number: 5,877,734

[45] Date of Patent: Mar. 2, 1999

[54] SURFACE DISCHARGE AC PLASMA DISPLAY APPARATUS AND DRIVING METHOD THEREOF

[75] Inventor: Kimio Amemiya, Koufu, Japan

[73] Assignee: Pioneer Electronic Corporation, Tokyo, Japan

[21] Appl. No.: 774,071

[22] Filed: Dec. 23, 1996

[30] Foreign Application Priority Data

Dec. 28, 1995 [JP] Japan ..... 7-343244
Nov. 22, 1996 [JP] Japan ..... 8-312183

[51] Int. Cl.[6] ..... G09G 3/28

[52] U.S. Cl. ..... 345/60; 315/169.4

[58] Field of Search ..... 345/60, 62, 66, 345/67, 68, 71, 72, 87; 313/585, 485; 315/169.1, 169.4

[56] References Cited

U.S. PATENT DOCUMENTS 5,640,068 6/1997 Amemiya .

5,661,500 8/1997 Shinoda et al. ..... 345/60

*Primary Examiner*—Xiao Wu

*Attorney, Agent, or Firm*—Sughrue, Mion, Zinn, Macpeak & Seas, PLLC

[57] ABSTRACT

A plasma display apparatus which improves the contrast of images displayed thereon. A plurality of paired row electrodes Xi, Yi are formed in parallel with each other in a surface discharge AC plasma display apparatus. A plurality of column electrodes are formed facing to the paired row electrodes through a discharge space, and extend perpendicularly to the paired row electrodes so as to define a unit light emitting region including an intersection formed every time the column electrode cross with the paired row electrodes. A gas mixture including Ne·Xe is sealed in the discharge space at a pressure ranging from 400 torr to 600 torr. The row electrodes in the unit light emitting region are formed to have a width w of 300 $\mu$m or more. The intensity of light emitted by discharge not related to display is suppressed.

12 Claims, 16 Drawing Sheets

SURFACE DISCHARGE AC PLASMA DISPLAY APPARATUS AND DRIVING METHOD THEREOF

FIELD OF THE INVENTION

This invention relates to a surface discharge AC plasma display apparatus and a driving method therefor.

DESCRIPTION OF THE RELATED ART

In recent years, a plasma display apparatus has been investigated for a variety of applications as a two-dimensional thin display apparatus. As one type of plasma display apparatus, a surface discharge AC plasma display panel having a memory function is known.

Most of the surface discharge AC plasma display panels employ a three-electrode structure. In this type of plasma display panel, two substrates, i.e., a front glass substrate and a back glass substrate, are positioned opposite to each other with a predetermined gap therebetween. On an inner surface (a surface opposite to the back glass substrate) of the front glass substrate as a display plane, a plurality of paired row electrodes, extending in parallel, are formed as paired sustain electrodes. On a back glass substrate, a plurality of column electrodes, extending across the paired row electrodes, are formed as address electrodes, and a fluorescent material is coated on the surface thereof. When viewed from the display plane, a pixel cell corresponding to a pixel is formed including an intersection of paired row electrodes and a column electrode, wherein a gap between the row electrodes near the intersection functions as a discharge gap in the pixel cell.

For driving the surface discharge AC plasma display panel having each of the pixel cells formed as described above, it is necessary to select whether or not each pixel cell is to emit light in each sub-frame. In this case, for providing a uniform difference in light emitting condition between pixel cells due to the difference in display data in each sub-frame, and also for stabilizing a discharge when writing data, a reset pulse is applied between the paired row electrodes of all pixel cells to initialize them by the action of a reset discharge caused by the application of reset pulses. Next, a data pulse is applied to the column electrode selected in accordance with data to cause selective discharges between the selected column electrodes and associated row electrodes to write data into corresponding pixel cells.

In the initialization of and the writing steps of data into pixel cells, there are two possible processes. First, selective writing is performed for selecting pixel cells, from which light is to be emitted, by previously generating a constant amount of wall charge in all pixel cells by the reset discharge and increasing the wall charges in the pixel cells by a so-called selective discharge using a scan pulse applied to selected column electrodes. Second, a selective erasure is performed for selecting pixel cells to be maintained unlit by extinguishing wall charges in the pixel cells by a selective discharge. Subsequently, a sustain pulse is applied to create a sustaining discharge for maintaining emitted light in selected pixel cells during the selective write or to create a sustaining discharge for maintaining emitted light in non-selected pixel cells during the selective erasure. Further, after a predetermined time has elapsed, data written in pixel cells is erased by applying erasure pulses to the pixel cells in any data write.

It will be understood from the foregoing that the reset discharge always takes place in all pixel cells even in those pixel cells which are not selected to emit light, i.e., pixel cells which display "black" (the state in which black is displayed in a pixel cell is referred to as "black display"). Also, when a data writing method is selective erasure, a selective discharge for writing data in pixel cells, i.e., a discharge for extinguishing wall charges, is also included in the "black display". Therefore, even if pixel cells are left unlit, these pixel cells have a slight luminance due to the discharge in the "black display".

Generally, the voltage of the reset pulse has a relatively higher level than the voltage level of the data scan pulse because of its purpose of generating wall charges, so that the intensity of light emitted during the "black display" is mostly attributable to the reset discharge. Also, the contrast of images displayed on a plasma display panel is determined by the ratio of the luminance of light emitted by a reset discharge to the luminance of light emitted by a sustaining discharge. From this fact, the discharge during "black display" constitutes a cause of deteriorating the contrast on the plasma display panel because the discharge during the "black discharge" makes higher the luminance of light emitted by the reset discharge.

To solve the problem mentioned above, attempts have been made to lower the reset discharge and the selective discharge for improving the contrast on the plasma display panel by reducing a pulse voltage, reducing the pulse width, and so on when these discharges take place. However, if the magnitude of the reset discharge is reduced when a selective erasure is performed, a smaller amount of wall charges is generated to cause incomplete initialization, and a smaller potential difference between a column electrode and a row electrode when data is written. These inconveniences further lead to an instable discharge between a column electrode and a row electrode, a failure in reliably carrying out a selective erasure for pixel cells, and so on, with the result that erroneous displays are more likely to occur. Also, since the selective write likewise suffers from instable initialization and selective discharge, erroneous displays are more likely to occur.

Furthermore, since charged particles generated by the reset discharge in either of the selective erasure and the selective write are gradually extinguished over time, the scan pulse is applied after a long time interval since the reset discharge has occurred. For example, the amount of charged particles existing in a discharge space of each pixel cell in an n-th row is minute immediately before the application of the scan pulse. In this case, even if the scan pulse having a narrow pulse width is simultaneously applied to a pixel cell with a small amount of charged particles existing therein, a discharge is not created immediately after the application of the scan pulse, so that wall charges corresponding to pixel data cannot be formed in some cases.

When the magnitude of the reset discharge or the selective discharge is reduced by supplying a lower voltage, a narrow pulse, or the like, the wall charges are maldistributed in the vicinity of a discharge gap so that the wall charge density gradually decreases toward a bus electrode due to an originally small amount of the generated wall charges. During a data writing period, the selective discharge, for selecting pixel cells wherein light to be emitted in accordance with data, is caused by a potential difference between a column electrode and a row electrode. The wall charge density is lower near the bus electrode of the row electrode farthest away from the discharge gap, wall charges near the bus electrode contribute less to producing the potential difference between a column electrode and a row electrode. Thus, the wall charges existing near the discharge gap only serve as effective wall charges for providing the selective discharge. As appreciated from the foregoing, only a portion of wall charges generated by the reset discharge is utilized at the beginning of the selective discharge causing useless light emission in the reset discharge, and thus degrading the contrast of images displayed on the plasma display apparatus.

OBJECTS OF THE INVENTION

In view of the problems mentioned above, it is a primary object of the invention to provide a surface discharge AC plasma display apparatus which is capable of improving the contrast of images displayed thereon while permitting a stable initialization discharge as well as a stable selective discharge for a data write in each pixel cell.

It is another object of the invention to provide a method for driving a matrix type of plasma display panel which is capable of emitting light for correct display corresponding to pixel data.

SUMMARY OF THE INVENTION

The present invention provides a surface discharge AC plasma display which comprises a plurality of paired row electrodes each extending in parallel with each other, a plurality of column electrodes facing the paired row electrodes through a discharge space, said column electrodes extending in a direction orthogonal to the plurality of paired row electrodes, the column electrodes defining unit light emitting regions including intersections formed every time the column electrodes cross with the paired row electrodes, and a dielectric layer covering the paired row electrodes, wherein a gas mixture including Neon (Ne) and Xenon (Xe) is hermetically sealed in the discharge space at a pressure ranging from 400 torr to 600 torr, and the row electrodes in the each unit light emitting region are formed to have a width of 300 $\mu$m or more.

The present invention also provides another surface discharge AC plasma display apparatus which comprises a plurality of paired row electrodes arranged facing to each other and extending in parallel with each other, a plurality of column electrodes opposite to the paired row electrodes with a spacing therebetween, said plurality of column electrodes extending in a direction orthogonal to the paired row electrodes, the column electrodes defining unit light emitting regions centered on intersections formed every time the column electrodes cross with the paired row electrodes, and a dielectric layer covering the paired row electrodes, wherein a pre-discharge pulse is applied between the paired row electrodes to perform a pre-discharge within a discharge gap which is a gap between row electrodes forming the paired row electrodes in each the unit light emitting region, unit light emitting regions which emit light are subsequently selected from the unit light emitting regions, and a sustaining discharge is subsequently created for sustaining the light emitted from the selected unit light emitting regions, and the row electrodes is shaped such that the pre-discharge is limited only in a region around the discharge gap.

The present invention further provides a method for driving a plasma display apparatus to display an image, wherein the plasma display apparatus comprises a plurality of paired row electrodes each extending in parallel with each other, a plurality of column electrodes facing to the paired row electrodes through a discharge space, said plurality of column electrodes extending in a direction orthogonal to the paired row electrodes, the column electrodes defining unit light emitting regions including intersections formed every time the column electrodes cross with the paired row electrodes, and a dielectric layer covering the paired row electrodes, the row electrode being formed to have a width of 300 $\mu$m or more in the unit light emitting region. The method comprises the steps of: applying first predischarge pulses to all of the paired row electrodes simultaneously to create predischarges between the paired row electrodes, applying a scan pulse to the paired row electrodes and simultaneously applying a pixel data pulse to the column electrode to write pixel data for selecting either one of light-on and light-off for a pixel, applying sustaining discharge pulses alternately to the row electrodes of the paired row electrodes to maintain a selected light-on or light-off state for the pixel, and applying an erasure pulse to the paired row electrodes to erase pixel data written therein, wherein the first pre-discharge pulse has a pulse waveform whose leading edge rises gradually as compared with that of the sustaining discharge pulse, such that the pre-discharge is limited only in a region around a discharge gap provided by a gap between the paired row electrodes in the unit light emitting region.

The present invention further provides method for driving a plasma display apparatus to display an image, wherein the plasma display apparatus comprises a plurality of paired row electrodes each extending in parallel with each other, a plurality of column electrodes facing the paired row electrodes through a discharge space, said plurality of column electrodes extending in a direction orthogonal to the paired row electrodes, the column electrodes defining unit light emitting regions including intersections formed every time the column electrodes cross with the paired row electrodes, and a dielectric layer covering the paired row electrodes, the paired row electrodes having projecting portions opposite to each other through a discharge gap in each the unit light emitting region. The method comprises the steps of applying first pre-discharge pulses to all of the paired row electrodes simultaneously to create a pre-discharge between the paired row electrodes, applying a scan pulse to the paired row electrodes and simultaneously applying a pixel data pulse to the column electrode to write pixel data for selecting either one of light-on and light-off for a pixel, applying sustaining discharge pulses alternately to the row electrodes of the paired row electrodes to maintain a selected light-on or light-off state for the pixel, and applying an erasure pulse to the paired row electrodes to erase pixel data written therein, wherein the first pre-discharge pulse has a pulse waveform whose leading edge rises gradually as compared with that of the sustaining discharge pulse, such that the pre-discharge is limited only in a region around a discharge gap provided by a gap between the paired row electrodes in the unit light emitting region.

According to the plasma display apparatus of the present invention, since the paired row electrodes each have a rather large width of 300 $\mu$m or more and therefore have a large electrode area, the intensity of light emitted by a sustaining discharge in each pixel cell is increased to improve the contrast of images displayed on the plasma display apparatus.

According to the plasma display apparatus of the present invention, since a pre-discharge prior to maintaining light emitted in each pixel cell is limited only to a region around a discharge gap between the paired row electrodes, the intensity of light emitted by a discharge not related to display an image is suppressed to improve the contrast of images displayed on the plasma display apparatus.

According to the method for driving a plasma display apparatus according to the invention, since the intensity of light emitted by a sustaining discharge in each pixel cell is increased, the contrast of images displayed on the plasma display apparatus is improved. In addition, since a discharge corresponding to a display is reliably created in each unit light emitting region, a precise display is accomplished.

According to the method for driving a plasma display apparatus according to the invention, since a pre-discharge prior to maintaining light emitted in each pixel cell is limited only to a region around a discharge gap between the paired row electrodes, the intensity of light emitted by a discharge not related to display an image is suppressed to improve the contrast of images displayed on the plasma display apparatus.

Described above, an AC plasma display apparatus of the invention features electrodes having specific shapes and sizes. Accordingly, a discharge for the initialization of a unit light emitting region is localized only in a region near a discharge gap between a pair of row electrodes in the unit light emitting region, thereby providing improved contrast of an image displayed.

In addition, in operation of the plasma display apparatus having the electrodes described above, the application of a pre-discharge pulse, whose leading edge rises gradually, to the pair of row electrodes results in enhancing the localization of the discharge for the initialization, thereby providing more improved contrast of an image displayed.

BRIEF DESCRIPTION OF THE DRAWINGS

The aforementioned aspects and other features of the invention are explained in the following description, taken in connection with the accompanying drawing figures wherein.

DESCRIPTION OF THE PREFERRED EMBODIMENTS

Preferred embodiments of a surface discharge AC plasma display apparatus and a method therefor according to the present invention will hereinafter be described with reference to the accompanying drawings.

Figure 1:
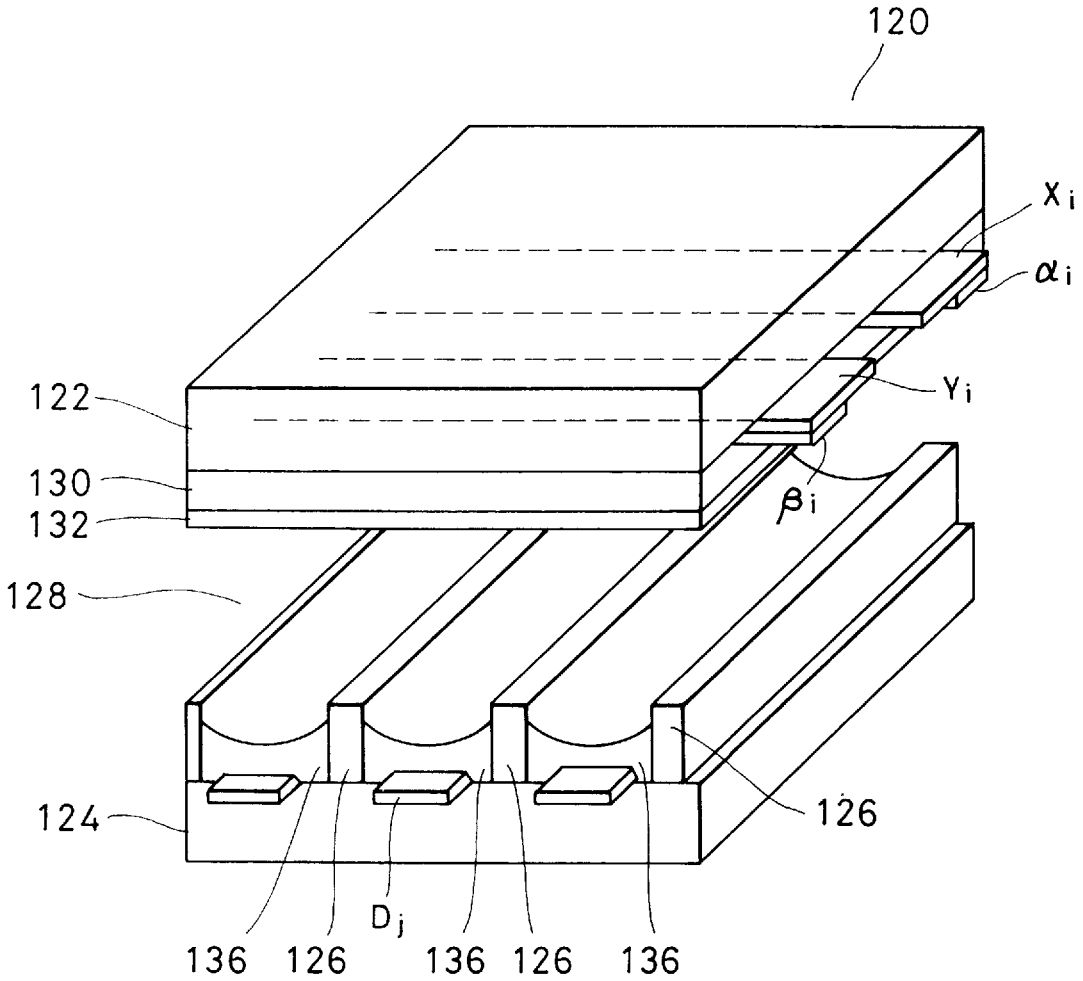
FIG. 1 is a perspective view illustrating the structure of a pixel cell in a plasma display apparatus according to the present invention.

FIG. 1 illustrates a structure of a plasma display panel in a perspective view, wherein reference numeral 120 generally designates a plurality of pixel cells constituting a surface discharge AC plasma display panel which employs a three-electrode structure. The illustrated plasma display panel has discharge spaces defined by a front substrate 122 and a back substrate 124, both made of transparent glass, facing each other in parallel through a gap ranging, for example, from 100–200 $\mu$m, and adjacent barrier ribs 126 disposed on the back surface 124 extending in parallel with each other in one direction. The front substrate 122 serves as a display plane, and a plurality of row electrodes Xi, Yi (i=1, 2, . . . , n) made by vapor depositing, for example, ITO, tin oxide (SnO), or the like in a thickness of several hundred nanometers (nm) are formed as sustain electrodes which extend in parallel with each other on the surface of the front substrate 122 opposite to the back substrate 124. Each of the row electrodes Xi, Yi is provided with a bus electrode $\alpha$i and $\beta$i, closely contacted thereon, having a narrower width relative to the width of the row electrodes Xi, Yi and made of a metal in order to function as an auxiliary electrode. Further, adjacent two row electrodes Xi, Yi are formed into a row electrode pair (Xi, Yi). Next, a dielectric layer 130 is formed in a film thickness ranging approximately from 20 $\mu$m to 30 $\mu$m, covering the row electrodes Xi, Yi, and an MgO layer 132 made of magnesium oxide (MgO) is deposited on the dielectric layer 130 in a film thickness of approximately several hundred nm.

On the other hand, the barrier ribs 126 formed on the back substrate 124 for supporting the gap with the front substrate 122 are formed in parallel with each other by, for example, thick film printing techniques, such that the longitudinal direction thereof extends perpendicular to the direction in which the row electrodes Xi, Yi extend. Consequently, the barrier ribs 126 having a width of 50 $\mu$m are aligned in parallel with a spacing of 400 $\mu$m intervening therebetween, by way of example. It will be understood that the spacing between adjacent barrier ribs 126 is not limited to 400 $\mu$m but may be changed to any appropriate value depending on the size and the number of pixels in a plasma display panel which serves as a display plane.

Furthermore, column electrodes Dj (j=1, 2, . . . , m) made of, for example, aluminum (Al) or aluminum alloy are formed as address electrodes in a film thickness of approximately 100 nm between adjacent barrier ribs 126 in the direction perpendicular to the direction in which the row electrodes Xi, Yi extend. Since the column electrodes Dj are made of a metal having a high reflectivity such as Al, Al alloy, or the like, they have a reflectivity equal to or higher than 80% in a wavelength band from 380 nm to 650 nm. It should be noted however that the material for the column electrodes Dj is not limited to Al and Al alloy but may be made of any appropriate metal or alloy thereof having a high reflectivity such as Cu, Au, or the like.

A fluorescent material layer 136 is then formed, for example, in a thickness ranging from 10 μm to 30 μm as a light emitting layer, covering the respective column electrodes Dj.

The front substrate 122 formed with the electrodes Xi, Yi, and Dj, the dielectric layer 130, and the light emitting layer 136 as described above and the back substrate 124 are air-tight bonded, the discharge spaces 128 are evacuated, and moisture is removed from the surface of the MgO layer 132 by baking. Next, an inert gas mixture including, for example, 2–7% of Ne·Xe gas as rare gas is filled in the discharge spaces 128 at a pressure ranging from 400 torr to 600 torr and sealed therein.

In this way, a unit light emitting region including an intersection of the pair of row electrodes Xi, Yi with a column electrode Dj crossing these row electrodes is defined as a pixel cell Pi,j which emits light with the fluorescent material excited by a discharge between the electrodes Xi, Yi, and Dj. Stated another way, in each pixel cell Pi,j, selection, sustaining, and erasure of a discharge for emitting light are carried out for a pixel cell Pi,j by appropriately applying voltages to the electrodes Xi, Yi, and Dj, thus controlling the light emitted therefrom.

Next, a shape and size of the row electrodes Xi, Yi will be described hereinunder.

Figure 2:
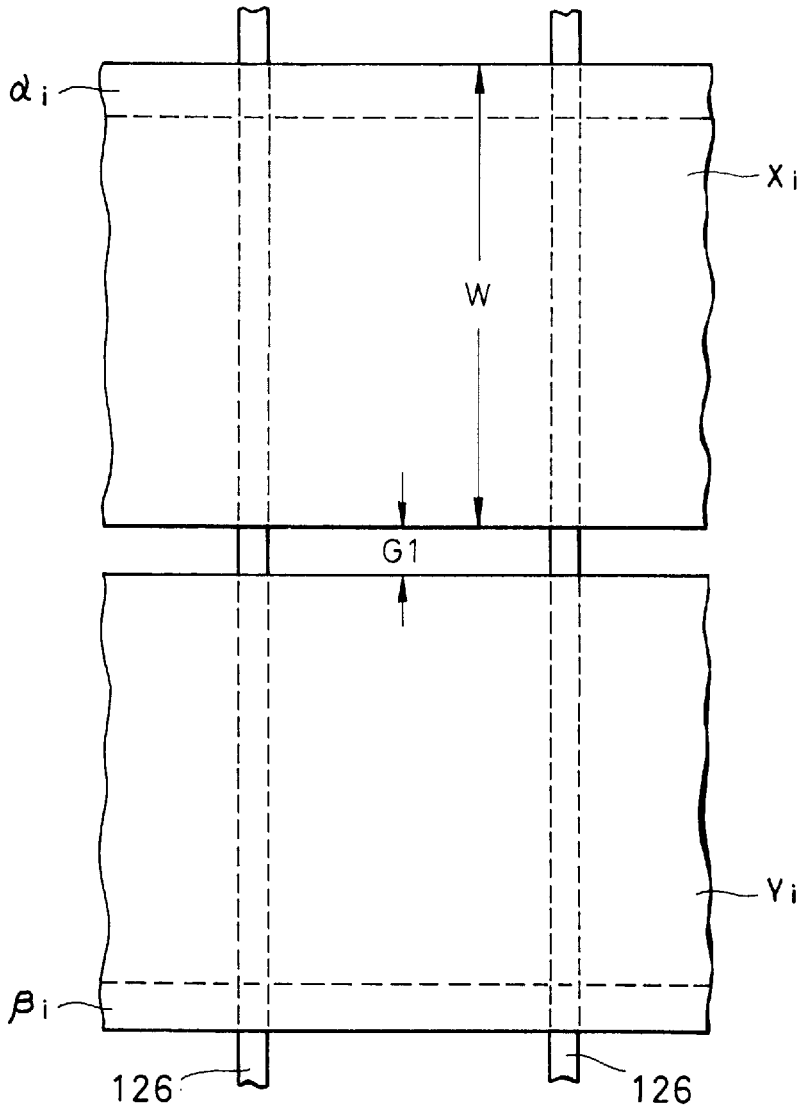
FIG. 2 is a top plan view of paired row electrodes of a first embodiment according to the present invention.

FIG. 2 illustrates the structure of a pair of row electrodes Xi, Yi of a first embodiment according to the present invention. As described above, the pair of row electrodes Xi, Yi are formed facing each other to extend in parallel with each other with a predetermined distance intervening therebetween. In this embodiment, each of the pair of row electrodes Xi, Yi has an appropriate thickness and a width w equal to or more than 300 μm. The width w of the row electrodes Xi, Yi may be of any value as long as it is 300 μm or more. The length of the row electrodes in a unit light emitting region corresponds to the spacing between adjacent barrier ribs 126. Further, in the foregoing structure, the gap G1 between the pair of row electrodes Xi, Yi in a pixel cell serves as a display gap.

Figure 3:
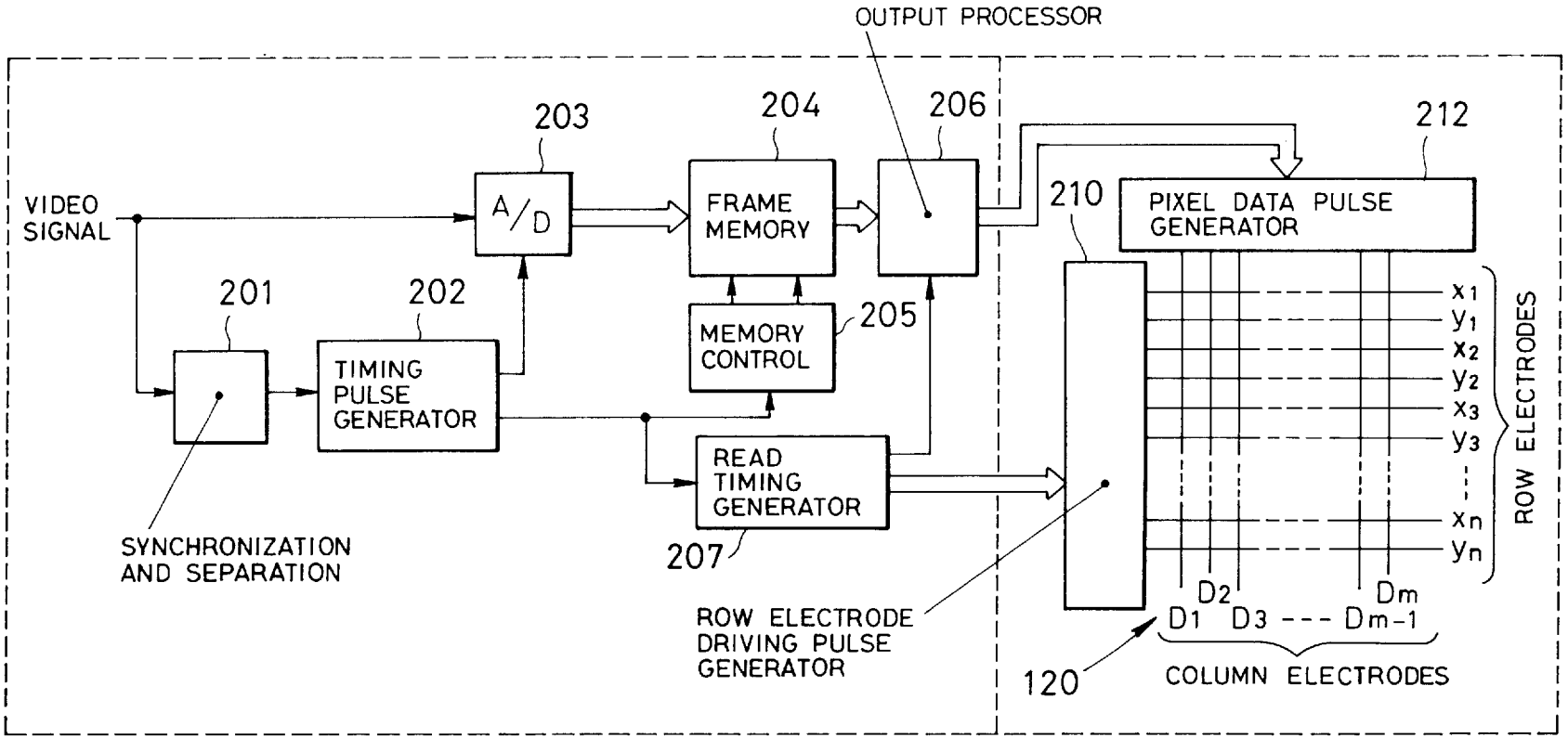
FIG. 3 is a block diagram illustrating a driving device for driving the plasma display apparatus according to the present invention.

FIG. 3 illustrates the configuration of a driving unit for driving the foregoing plasma display panel 120.

Referring to FIG. 3, a synchronization separating circuit 201 extracts a horizontal and a vertical synchronization signal from an input video signal supplied thereto, and supplies the extracted synchronization signals to a timing pulse generator 202. The timing pulse generator 202 generates an extracted synchronization signal timing pulse on the basis of the extracted horizontal and vertical synchronization signals and supplies the timing pulse to an analog-to-digital (A/D) converter 203, a memory control circuit 205, and a read timing signal generator 207, respectively. The A/D converter 203 converts the input video signal to digital pixel data corresponding to each pixel in synchronism with the extracted synchronization signal pulse, and supplies the digital pixel data to a frame memory 204. A memory control circuit 205 supplies the frame memory 204 with a write signal and a read signal, both synchronized with the extracted synchronization signal timing pulse. The frame memory 204 sequentially receives each pixel data supplied from the A/D converter 203 in response to the write signal. Also, the frame memory 204 sequentially reads pixel data stored therein in response to the read signal and supplies the read pixel data to an output processor 206 at the subsequent stage. A read timing signal generator 207 generates various types of timing signals for controlling discharge and light emission operations, and supplies the timing signals to an electrode driving pulse generator 210 and the output processor 206, respectively. The output processor 206 supplies a pixel data pulse generator 212 with pixel data supplied from the frame memory 204 in synchronism with a timing signal from the read timing signal generator 207.

The pixel data pulse generator 212 generates a pixel data pulse DP corresponding to each pixel data supplied from the output processor 206, and applies the pixel data pulse DP to the column electrodes D1–Dm of the plasma display panel 120.

The row electrode driving pulse generator 210 generates first and second pre-discharge pulses for performing a pre-discharge between all pair of row electrodes in the plasma display panel 120, a priming pulse for arranging charged particles, a scan pulse for writing pixel data, a sustaining discharge pulse for sustaining a discharge for emitting light in accordance with pixel data, and an erasure pulse for stopping the discharge for light emission. The row electrode driving pulse generator 210 supplies the row electrodes X1–Xn and Y1–Yn of the plasma display panel 120 with these pulses at times corresponding to a various types of timing signals supplied from the read timing signal generator 207.

Next, a method of driving the plasma display apparatus including the pair of row electrodes Xi, Yi having the structure illustrated in FIG. 2 and the driving device illustrated in FIG. 3 will be described with reference to FIG. 4.

Figure 4:
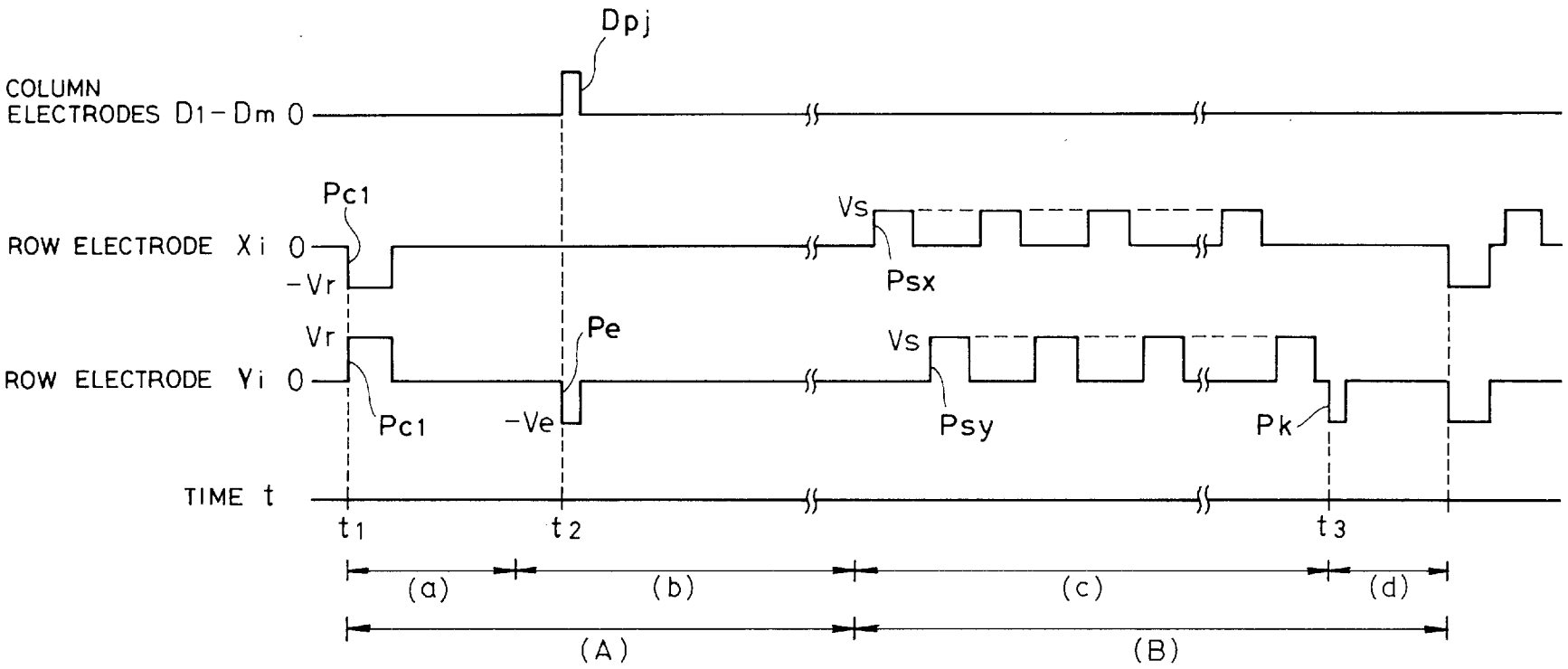
FIG. 4 is a waveform diagram for explaining a first embodiment of operation waveforms applied to respective electrodes for driving a pixel cell.

FIG. 4 shows a first embodiment of a method according to the present invention, and specifically illustrates the timing at which various types of pulses are applied for driving the plasma display panel 120 in accordance with the method of the first embodiment.

Considering a single pixel cell Pi,j, the pixel cell Pi,j provides dynamic display by repeating a sub-field composed of a non-display period (A) including a pixel initialization period (a) and a data writing period (b), and a display period (B) including a sustaining discharge period (c) and a data erasure period (d).

In the period (a), wherein no pixel data is supplied to the pixel cell Pi,j, the row electrode driving pulse generator 210 simultaneously supplies all row electrodes Xi, Yi, of all pairs of row electrodes with a reset pulse Pc1 as the first pre-discharge pulse at time t1. In this case, in the pair of row electrodes Xi, Yi, one electrode Xi in the pair is supplied with a potential −Vr having a predetermined polarity, for example, a negative polarity in this embodiment, as a first sub-pulse, while the other electrode Yi in the pair is supplied with a potential +Vr having the polarity opposite to that of the first sub-pulse, for example, a positive polarity as a second sub-pulse. When a potential difference 2Vr generated by the potentials −Vr and +Vr applied to the respective electrodes exceeds a discharge start voltage, the pixel cell starts a discharge. This reset discharge, i.e., a pre-discharge, instantaneously terminates, and wall charges generated by the reset discharge substantially uniformly remain on the dielectric layer 130 in all the pixel cells.

Next, in the period (b), the pixel data pulse generator 212 sequentially supplies the column electrodes D1–Dm with pixel data pulses DP1–DPn having positive voltages corresponding to pixel data of respective rows. The row electrode driving pulse generator 210, in turn, supplies the row electrodes Y1–Yn with a scan pulse having a small pulse width, i.e., a data selection pulse Pe in synchronism with each application timing of the pixel data pulses DP1–DPn. For example, at time t2, pixel data is supplied to a pixel cell Pi,j, and the data pulse having a voltage level corresponding to the pixel data and the scan pulse Pe are simultaneously applied to determine whether or not the pixel cell Pi,j emits light. In other words, a selective discharge caused by the application of the scan pulse to a pixel cell results in a change in the amount of wall charges in the associated pixel cell.

For example, for a selective erasure, if the contents of pixel data show logical "0" indicating that an associated pixel cell is prohibited from emitting light, the pixel data pulse DP is simultaneously applied together with the scan pulse Pe to the pixel cell, so that wall charges formed inside the pixel cell are extinguished, thus determining that the pixel cell will not emit light in the period (c). On the other hand, if the contents of pixel data show logical "1" indicating that an associated pixel cell is permitted to emit light, the scan pulse only is applied to the pixel cell so that no discharge is created, whereby wall charges formed inside the pixel cell are maintained as they are, thus determining that the pixel cell will emit light in the period (c). Stated another way, the scan pulse Pe serves as a trigger for selectively erasing the wall charges formed inside each pixel cell in accordance with associated pixel data.

On the other hand, for a selective write, the pixel data pulse at logical "1" and the scan pulse are simultaneously applied to the pixel cell to increase wall charges, thus determining that the pixel cell will emit light in the subsequent period (c).

Next, in the period (c), the row electrode driving pulse generator 210 continuously applies a series of sustaining discharge pulses Psx having a positive voltage to each of the row electrodes X1–Xn and also continuously applies a sustaining discharge pulse Psy having a positive voltage to each of the row electrodes Y1–Yn at timings staggered from the timings at which each of the sustaining discharge pulses Psx is applied, to continue the discharge for emitting light for display corresponding to pixel data written during the period (b). In this case, in a pixel cell in which wall charges are left during the preceding period (b), the sustaining discharge pulse applied thereto causes a discharge through a discharge gap between the pair of row electrodes by charge energy possessed by the wall charges themselves and energy of the sustaining discharge pulse, thereby causing the pixel cell to emit light. On the other hand, in a pixel cell in which wall charges have been extinguished, since a potential difference Vs generated in the pixel cell by the sustaining discharge pulse applied thereto is lower than the discharge start voltage, no discharge occurs in this pixel cell which, therefore, does not emit light.

Next, in the period (d), when the row electrode driving pulse generator 210 applies an erasure pulse Pk to all of the row electrodes Y1–Yn at time t3, the sustaining discharge is stopped in the pixel cells, whereby pixel data written into the pixel cells in the period (b) are all erased.

In the manner described above, each pixel cell undergoes the following driving processing: in the period (a), a reset pulse is applied to the pair of row electrodes Xi, Yi for initialization to cause a reset discharge centered at the discharge gap Gi as a pre-discharge; in the period (b), pixel data is written into the corresponding pixel cell, and a selection is made as to which pixel cells are to emit light; in the period (c), in pixel cells which have been written with pixel data and have been selected to emit light, the sustaining discharge pulse is periodically applied to the pair of row electrodes to sustain the pixel cells to emit light for display; and in the period (d), the erasure pulse is applied to one of the pair of row electrodes to erase the written data.

In the driving processing, if a lower voltage or a shorter pulse width of the reset pulse results in an insufficient reset discharge in the initialization taking place during the period (a), a smaller amount of wall charges only is generated by such a reset discharge, wherein the wall charges mainly concentrate in the vicinity of the discharge gap G1 shown in FIG. 2.

In the subsequent period (b), when data indicative of a selective erasure is written, a selective discharge takes place in accordance with the data to extinguish wall charges existing near the discharge gap G1. In this case, since the wall charges only exist near the discharge gap G1 and the amount of charges is small, the wall charges in a selected pixel cell can be substantially completely extinguished even if the pulse having a lower voltage or a narrower pulse width is applied for the selective discharge. In other words, it is possible to suppress the intensity of light emitted by a discharge which is not related to display.

In the subsequent period (c), even if the sustaining discharge pulse is applied, no discharge is created in a pixel cell in which wall charges have been extinguished by the selective discharge, so that the pixel cell does not emit light. On the other hand, the application of the sustaining discharge pulse creates a discharge in a pixel cell in which no selective discharge has occurred and therefore wall charges still remain, causing the pixel cell to start light emission.

Figure 5:
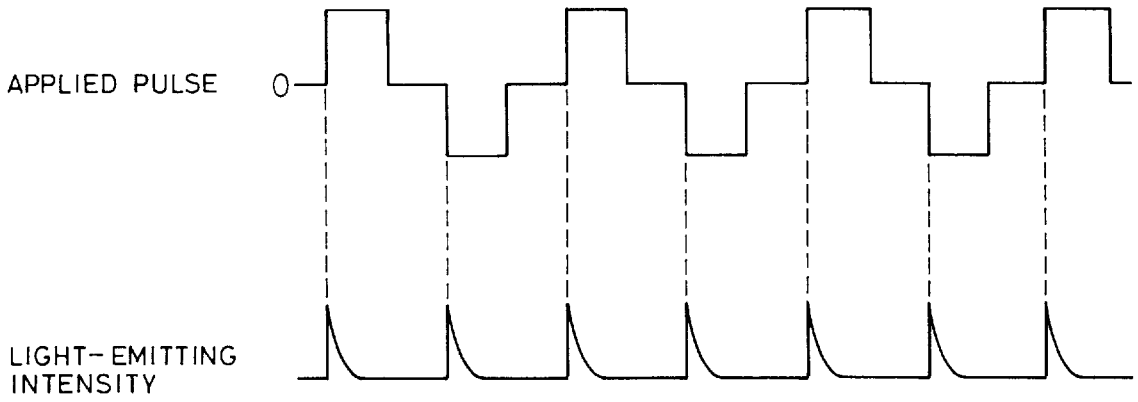
FIG. 5 is a waveform diagram for explaining the relationship between a pulse applied to an electrode and the intensity of emitted light in an equilibrium state of a discharge.

Generally, when the pulse is repetitively applied to continue the sustaining discharge as illustrated in FIG. 5, the discharge ends up in an equilibrium state, where generated wall charges reach a constant amount, and the intensity of emitted light also becomes constant as illustrated in FIG. 5. Assume that the amount of wall charges in the equilibrium state is denoted as Q. If the amount Q of wall charges initially exists in a pixel cell, the discharges created by the respective pulses are in the equilibrium state from the beginning. However, when an initial amount of wall charges is less than X in a pixel cell which has just started emitting light, periodical applications of the sustaining discharge pulse to the paired row electrodes Xi, Yi allow the amount of wall charges remaining in the pixel cell to gradually increase toward Q. In this case, the intensity of light emitted by the respective sustaining discharge pulses also increases as a larger amount of wall charges is generated.

Figure 6:
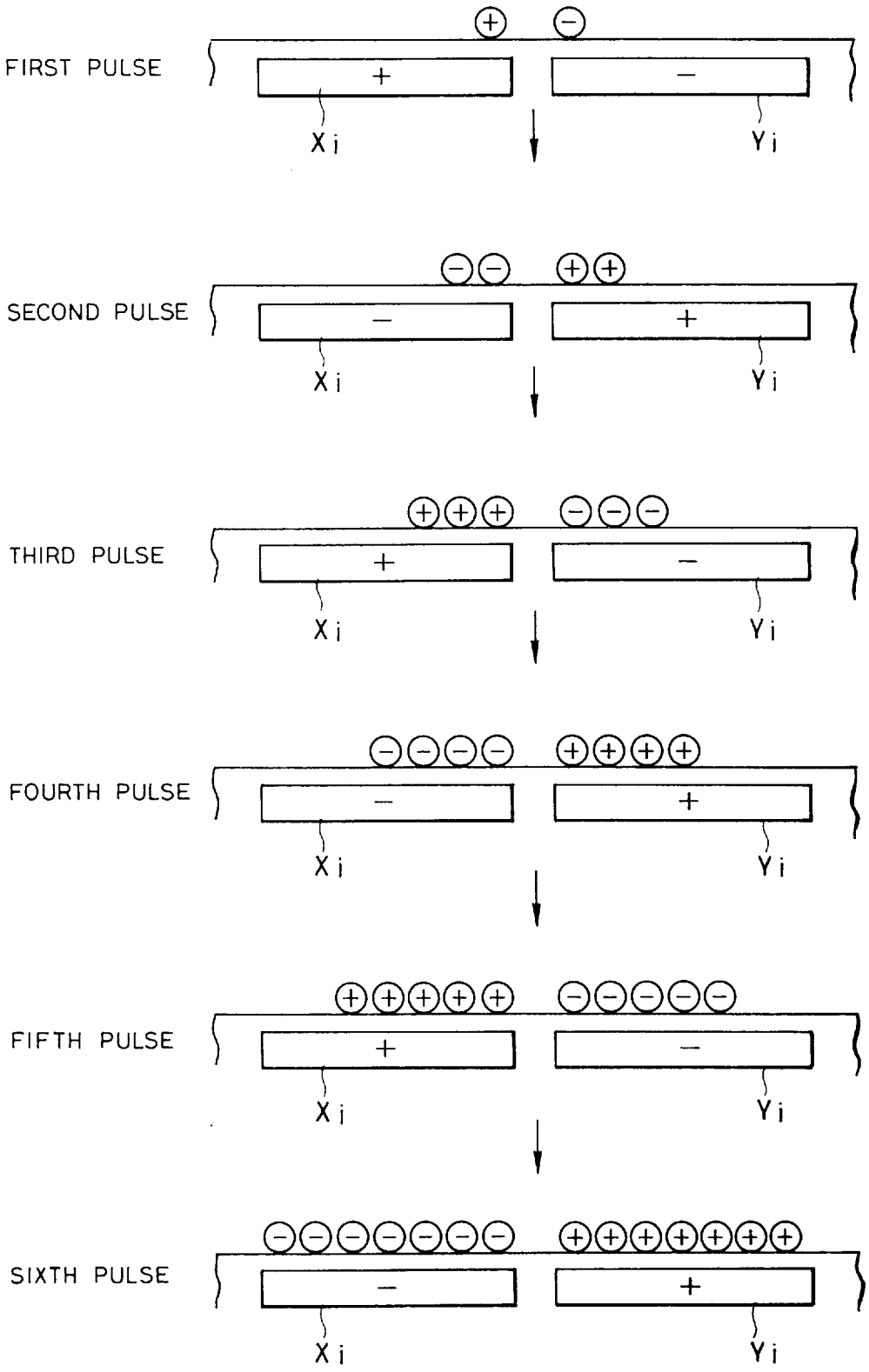
FIG. 6 is a diagram for explaining the distribution of wall charges near row electrodes in a pixel cell which changes by repetitive applications of a pulse.

In addition, since the plasma display apparatus of the present invention is of a surface discharge type, it is also necessary to take into consideration the distribution of wall charges near electrodes. In an equilibrium state of a sustaining discharge, an amount Q' of wall charges extensively distributes over entire regions around the row electrodes Xi, Yi on the dielectric layer 130. Thus, if the wall charges exist only near the discharge gap G1 and its amount is less than Q', the distribution of the wall charges gradually extends in a direction away from the discharge gap G1 as the discharge is repeated, as illustrated in FIG. 6. In this case, the intensity of light emitted from the pixel cell becomes gradually higher conforming to the amount of generated charges, and eventually reaches a fixed level.

Thus, since the pair of row electrodes Xi, Yi arranged on both sides of the discharge gap G1 through which the reset discharge, the selective discharge and the sustaining discharge occur, as illustrated in FIG. 2, have a rather large width w, which is equal to or more than 300 $\mu$m, and an enlarged area, wall charges gradually spread in a direction away from the discharge gap G1 by repeated sustaining discharges, and eventually spread over the entire row electrodes Xi, Yi to reach an equilibrium state. The sustaining discharge extensively occurs over the entire paired row electrodes Xi, Yi in the equilibrium state, and the pixel cell emits light which is ultraviolet rays emitted from a discharge region remaining in the equilibrium state. As a result the entire row electrodes Xi, Yi appear to emit light in the pixel cell Pi,j, when viewed from the display plane side.

The number of pulses required to allow the wall charges to spread over the entire row electrodes, i.e., to bring the wall charges in the equilibrium state, during the period (c) is approximately five or six. Since the sustaining discharge pulse is applied approximately 50–500 times in each sub-frame, the wall charges substantially instantaneously reach the equilibrium state as the period (c) of the sub-frame is entered, wherein the entire row electrodes in each pixel cell appear to emit light when viewed from the display plane side. It will be appreciated from the foregoing that even an insufficient reset discharge will never affect the luminance of light emitted from pixel cells during display.

As described above, since the structure of the pair of row electrode Xi, Yi illustrated in FIG. 2 increase the intensity of light emitted by the action of the sustaining discharge, it is possible to improve the contrast of images displayed on the plasma display panel.

Figure 7:
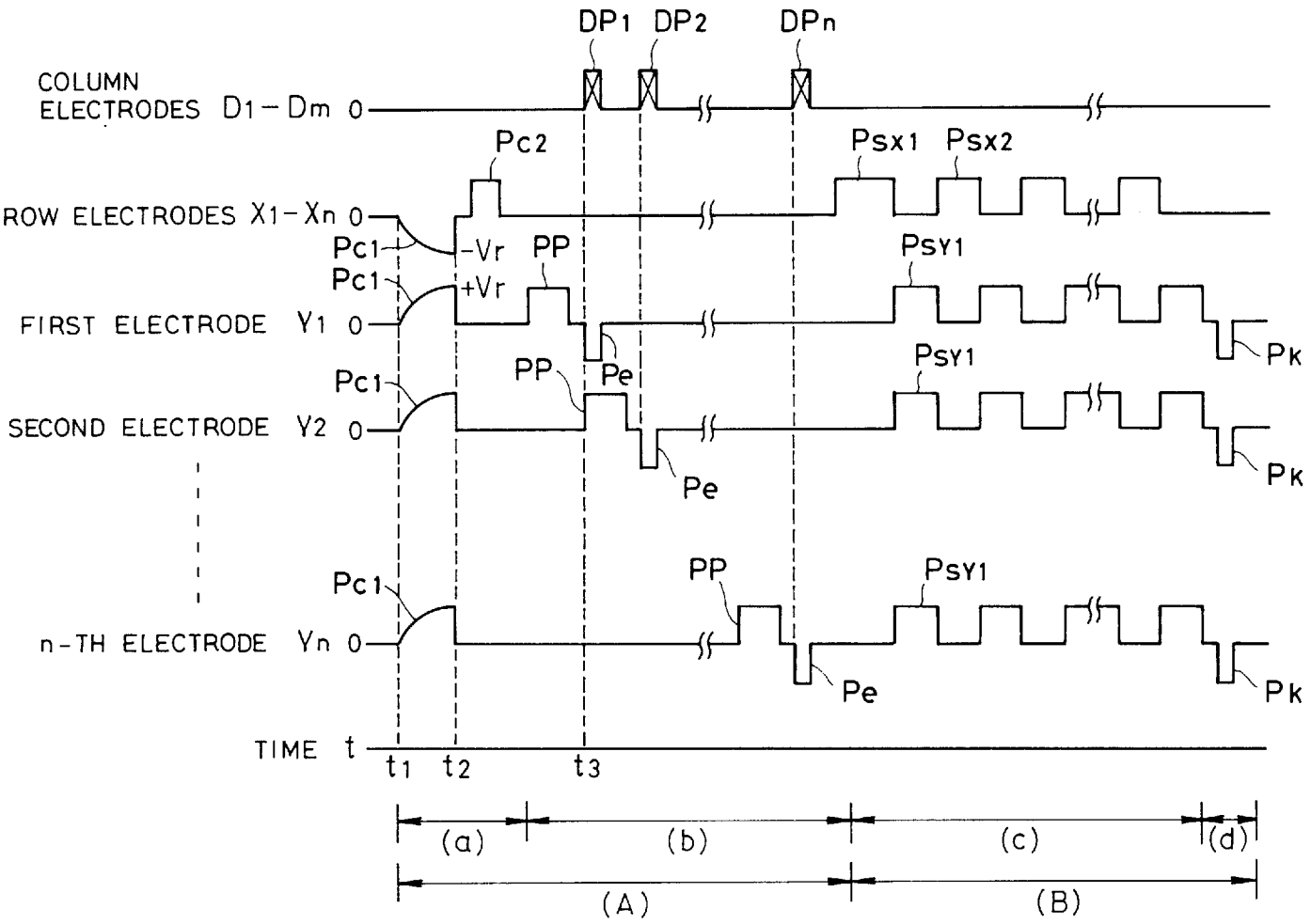
FIG. 7 is a waveform diagram for explaining a second embodiment of operation waveforms applied to respective electrodes when a pixel cell is driven.

FIG. 7 shows a second embodiment of the method according to the present invention, and specifically illustrates the timing at which various types of pulses are applied for driving the plasma display panel 120 employing the electrode structure illustrated in FIG. 2 in accordance with the method according to the second embodiment.

In a manner similar to the method illustrated in FIG. 4, a pixel cell Pi,j provides dynamic display by repeating a sub-field composed of a non-display period (A) including a pixel initialization period (a) and a next data write period (b), and a display period (B) including a sustaining discharge period (c) and a data erasure period (d).

In the period (a), wherein no pixel data is supplied to the pixel cell Pi,j, the row electrode driving pulse generator 210 simultaneously supplies all row electrodes Xi, Yi, of all row electrode pairs with a reset pulse Pcl as the first pre-discharge pulse at time t1. In this case, in each of the pair of row electrodes Xi, Yi, one electrode Xi in the pair is supplied, for example, with a negative-polarity pulse having such a waveform that slowly goes down from the leading edge and reaches a potential −Vr at the trailing edge, as a first sub-pulse, while the other electrode Yi is applied, for example, with a positive-polarity pulse, opposite to the first sub-pulse, having such a waveform that slowly goes up from the leading edge and reaches a potential +Vr at the trailing edge as a second sub-pulse. As can be seen, the first predischarge pulse illustrated in FIG. 7 has a waveform which slowly rises, as compared with that of the first pre-discharge pulse and the sustaining discharge pulse illustrated in FIG. 4. When a potential difference generated between the paired row electrodes by the first and second sub-pulses exceeds a discharge start voltage, the pixel cell starts a discharge. This reset discharge, i.e., a pre-discharge, instantaneously terminates such that wall charges generated by the reset discharge substantially uniformly remain on the dielectric layer 130 in all the pixel cells.

However, since the pulse slowly rises at the leading edge, the magnitude of the pre-discharge created by the first pre-discharge pulse Pc1 is smaller than that of the pre-discharge created by the first pre-discharge pulse illustrated in FIG. 4. The pre-discharge with a smaller magnitude is more likely to cause a reduced amount of generated wall charges and a larger difference in the amount of generated wall charges in respective pixel cells over the entire panel.

To solve this problem, i.e., to generate a uniform amount of wall charges in respective pixel cells over the entire plasma display panel, the row electrode driving purse generator 210 supplies one of the pair of row electrodes, for example, the row electrode Xi with a second pre-discharge pulse Pc2 having the polarity opposite to that of the first sub-pulse at time t2 immediately after the first pre-discharge pulse has been applied in the period (a), to cause another pre-discharge to correct non-uniformity in the amount of wall charges generated in the respective pixel cells, thus enabling a uniform amount of wall charges to be generated in the respective pixel cells over the entire plasma display panel.

Next, the pixel data pulse generator 212 sequentially applies the column electrodes D1–Dm with pixel data pulses DP1–DPn having positive voltages corresponding to pixel data of respective rows. The row electrode driving pulse generator 210, in turn, supplies the row electrodes Y1–Yn with a scan pulse having a small pulse width, i.e., a data selection pulse Pe in synchronism with each application timing of the pixel data pulses DP1–DPn. In this case, immediately before supplying the respective row electrodes Yi with the scan pulse Pe, the row electrode driving pulse generator 210 supplies the one row electrode Yi, paired with the other row electrode Xi, with a priming pulse PP having the polarity opposite to that of the first sub-pulse Pc1, for example, the positive polarity, as illustrated in FIG. 7. For example, a pixel cell P1,j is supplied with a data pulse corresponding to associated pixel data at time t3 to determine whether or not the pixel cell P1,j emits light, in a manner similar to the driving method illustrated in FIG. 4.

As described above, the application of the priming pulse PP causes charged particles generated by the pre-discharges caused by the pulses Pc1 and Pc2 and reduced over time to be restored in the discharge space 128. Thus, when a desired amount of charged particles exists on the dielectric layer 130 in the discharge space 128, pixel data can be written by applying the scan pulse Pe.

For example, for a selective erasure, if the contents of pixel data show logical "0" indicating that an associated pixel cell are prohibited from emitting light, the pixel data pulse DP and the scan pulse Pe are simultaneously applied to the pixel cell, so that wall charges formed inside the pixel cell is extinguished, thus determining that the pixel cell will not emit light during the period (c). On the other hand, if the contents of pixel data show logical "1" indicating that an associated pixel cell is permitted to emit light, the scan pulse only is applied to the pixel cell so that a discharge is not created, whereby wall charges formed inside the pixel cell are sustained as they are, thus ensuring that the pixel cell will emit light in the period (c).

On the other hand, for a selective write, a pixel data pulse at logical "1" and a scan pulse are simultaneously supplied to increase the wall charges, thus determining that the pixel cell will emit light in the next period (c).

Next, in the period (c), the row electrode driving pulse generator 120 continuously supplies the respective row electrodes X1–Xn with a series of sustaining discharge pulses Psx having a positive voltage and also continuously supplies the respective row electrodes Y1–Yn with a series of sustaining discharge pulses Psy having a positive polarity at times staggered from the times at which the sustaining discharge pulses Psx are applied, to sustain a light emitting state for display corresponding to pixel data which have been written during the period (b), in a manner similar to the driving method illustrated in FIG. 4. Over a period in which the sustaining discharge pulses are alternately applied to the pair of row electrodes Xi, Yi in a continuous manner, only those pixel cells having wall charges remaining therein sustain the discharge light emitting state for display.

It should be noted that in the sustaining discharge process, the sustaining discharge pulse Psx1 first applied to the row electrode has a pulse width larger than those of the sustaining discharge pulses Psy1, Psx2, . . . . applied at second and subsequent times.

The reason for the different pulse widths will be next explained. Since the data write into pixel cells using pixel data and scan pulses is performed sequentially from the first to the n-th rows, a time taken to enter the sustaining discharge process after pixel data is written into pixel cells is different from one row to another. Specifically, over the entire panel, even in a situation, for example, in which the pixel data has determined that wall charges are maintained in pixel cells, the amounts of wall charges and space charges inside pixel cells immediately before the sustaining discharge period (c) may be different from one row to another. It is therefore possible that the sustaining discharge is not created in a pixel cell in which the amount of wall charges has been reduced as the time has passed from the writing of pixel data to the sustaining discharge. To avoid such a situation, the first sustaining discharge pulse having a larger pulse width is employed such that a potential difference generated by the application of the first sustaining discharge pulse can remain active between the paired row electrodes for a period longer than usual so as to ensure that the first sustaining discharge is created in either of pixel cells which have been selected to emit light for display and to provide a uniform amount of charges in the pixel cells selected to emit light over the entire panel. The first sustaining discharge thus created by the sustaining discharge pulse having a larger pulse width enables a uniform image to be displayed over the entire panel.

Next, the row electrode driving pulse generator 210 simultaneously applies an erasure pulse Pk to the row electrodes Y1–Yn to erase all pixel data which have been written into pixel cells during the period (b).

As described above, in the method of driving the plasma display panel illustrated in FIG. 7, all row electrodes are simultaneously supplied with the first pre-discharge pulse having a waveform which slowly rises for initialization, and the first sustaining discharge pulse applied to the row electrodes is provided with a wider pulse width in the sustaining display process, thereby driving the panel to emit light for display.

By thus providing the first pre-discharge pulse having a slowly rising waveform, it is possible to limit the luminance of light emitted from pixel cells due to the pre-discharge to a lower level. In addition, since the first sustaining discharge pulse has a pulse width wider than that of the second and subsequent sustaining discharge pulses to ensure that the sustaining discharge occurs in pixel cells, the amounts of charges existing in respective pixel cells are substantially uniform for the same pixel data over the entire panel, thus making it possible to precisely emit light for display.

It should be noted that the first pre-discharge pulses Pc1 applied to the row electrode pair Xi, Yi have a waveform which slowly goes up or down from the leading edge as can be seen in FIG. 7. However the first pre-discharge pulse applied to either of the paired row electrodes Xi, Yi may have a waveform which abruptly goes up or down at the leading edge, similarly to the waveform of the first pre-discharge pulse illustrated in FIG. 4, while the first pre-discharge pulses applied to the other row electrode may have a waveform which slowly goes down or up. Also, in the latter case, similar effects can be produced.

Figure 8:
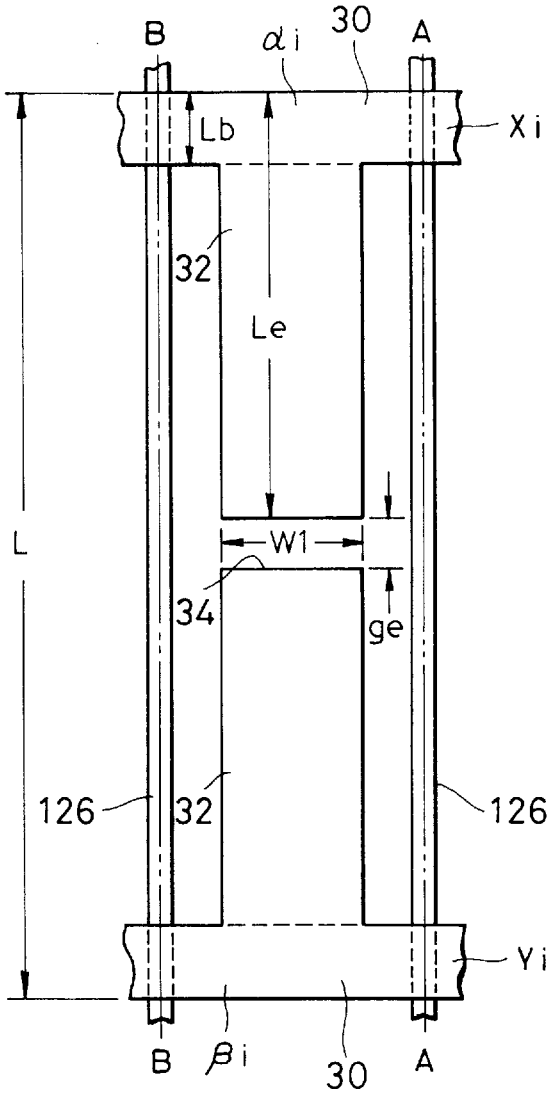
FIG. 8 is a top plan view of paired row electrodes of a second embodiment according to the present invention.

FIG. 8 illustrates the structure of the pairs of row electrodes Xi, Yi of a second embodiment. Referring to FIG. 8, each of the row electrodes Xi, Yi in each pixel cell Pi,j comprises a main body 30 extending in the longitudinal direction of the row electrode and a projecting portion 32 projecting from the main body 30 in a direction intersecting with the extending direction of the main body 30 toward the other row electrode which forms pair therewith. The projecting portions 32 of both the row electrodes Xi, Yi have ends opposite to each other through a gap 'ge'. Preferably, the projecting portion 32 projects in the direction perpendicular to the direction in which the main body 30 extends. In this embodiment, the gap 'ge' serves as a discharge gap.

Next, the dimensions of respective parts are shown for the row electrodes Xi, Yi. Since the length of the main body 30 in a pixel cell in the extending direction (corresponding to the length of a line segment A—A or B—B in FIG. 8) corresponds to the spacing between adjacent barrier ribs 126, it is 400 $\mu$m. As illustrated in FIG. 8, assuming that a total length of the width of the main body 30 and the length of the projecting portion 32 in the longitudinal direction is 'le', and the width of the end of the projecting portion 32 is 'w1', 'le' ranges from 300 $\mu$m to 500 $\mu$m, and w1 is slightly shorter than the width of a pixel cell, i.e., 400 $\mu$m. In the structure illustrated in FIG. 8, as an exemplary dimension for le, le is assumed to be 300 $\mu$m. For the dimensions of other parts, assume that the length 'L' in a direction across the row electrode in a light emitting pixel region is 670 $\mu$m, the gap 'ge' between the row electrodes Xi, Yi forming a pair is 70 $\mu$m, and the width 'b' of the main body 30 of the row electrode Xi, Yi is 100 $\mu$m.

A plasma display apparatus employing the pairs of row electrodes Xi, Yi illustrated in FIG. 8 is driven by any of the two driving methods illustrated in FIGS. 4 and 7 to provide a display thereon, similarly to a plasma display apparatus employing the pairs of row electrodes of the first embodiment illustrated in FIG. 2. It is therefore appreciated that the plasma display apparatus employing the row electrode pairs illustrated in FIG. 8 also limits the luminance of light emitted by a pre-discharge, and increases the intensity of light emitted by a sustaining discharge to improve the contrast of images displayed on the plasma display apparatus, as is the case of the plasma display apparatus employing the pairs of row electrodes of the first embodiment.

It should be noted that while the total length 'le' of the width of the main body 30 and the length of the projecting portion 32 in the longitudinal direction of the row electrode Xi or Yi is assumed to be 300 $\mu$m in the foregoing embodiment, the present invention is not limited to this specific value, and similar effects to those of the foregoing embodiment can be produced as long as the row electrode is formed such that the length 'le' is 300 $\mu$m or more.

Figure 9:
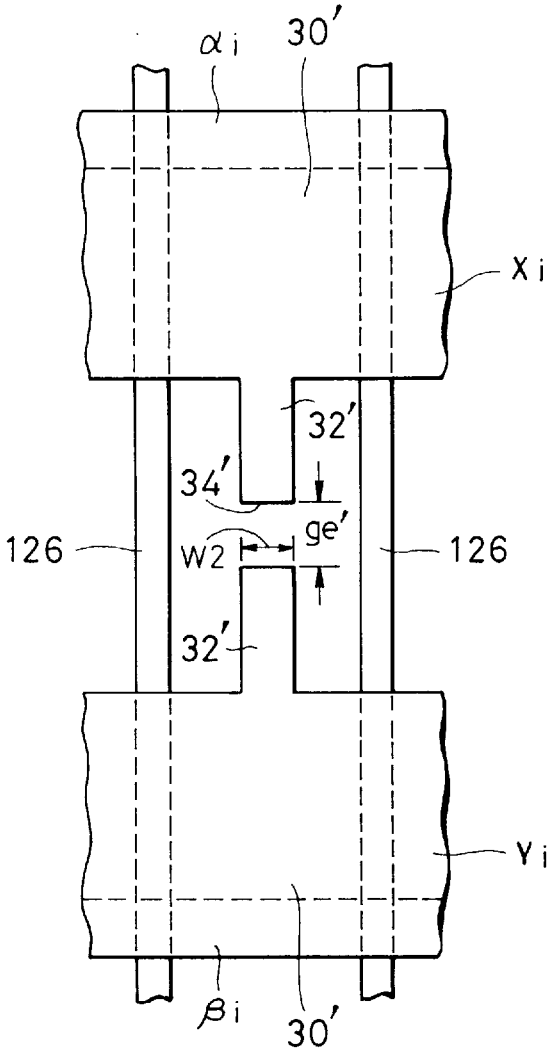
FIG. 9 is a top plan view of paired row electrodes of a third embodiment according to the present invention.

FIG. 9 illustrates the structure of the pair of row electrodes Xi, Yi of a third embodiment according to the invention. Referring to FIG. 9, each of the pair of row electrodes Xi, Yi in a pixel cell Pi,j comprises a main body 30' extending in the longitudinal direction of the row electrode and a projecting portion 32' projecting from the main body 30' in a direction intersecting with the extending direction of the main body 30' toward the other row electrode which forms a pair therewith. The projecting portions 32' of both the row electrodes Xi, Yi have ends 34' opposite to each other through a gap ge'. Preferably, the projecting portion 32' projects in the direction perpendicular to the direction in which the main body 30 extends. Compared with the structure of the pair of row electrodes illustrated in FIG. 8, the length of the projecting portion 32' in the extending direction is short relative to the width of the main body 30', and the end 34' of the projecting portion 32' has a narrow width w2, so that a portion of the row electrode near the discharge gap ge' is reduced in area.

A plasma display apparatus employing the pair of row electrodes Xi, Yi having the structure illustrated in FIG. 9 is also driven by either of the two driving methods illustrated in FIGS. 4 and 7 for providing display, in a manner similar to the plasma display apparatus employing the pair of row electrodes of the first embodiment. In the plasma display apparatus employing the pair of row electrodes Xi, Yi of FIG. 9, if an applied reset pulse is reduced in voltage, pulse width, or the like during the initialization, a reset discharge occurs only in a limited region near the discharge gap ge'. The intensity of light emitted by this reset discharge is low since the width w2 of the end 34' of the projecting portion 32' is approximately one third of the width of the pixel cell. In addition, since a selective discharge concentrates in a region near the discharge gap ge', the intensity of light emitted by the selective discharge is also low. When the process proceeds to a sustaining discharge, the sustaining discharge created by the first sustaining discharge pulse occurs only in a limited region near the discharge gap ge', so that the intensity of light emitted thereby is low. However, since the emitted light spreads over the entire electrodes with the application of several pulses as illustrated in FIG. 6, the intensity of the emitted light is increased. Since the reset discharge occurs only in a limited discharge region near the discharge gap ge' to restrict the intensity of light emitted thereby as described above, the contrast provided by the emitted light is improved in the plasma display apparatus employing the paired row electrodes Xi, Yi of FIG. 9.

Figure 10:
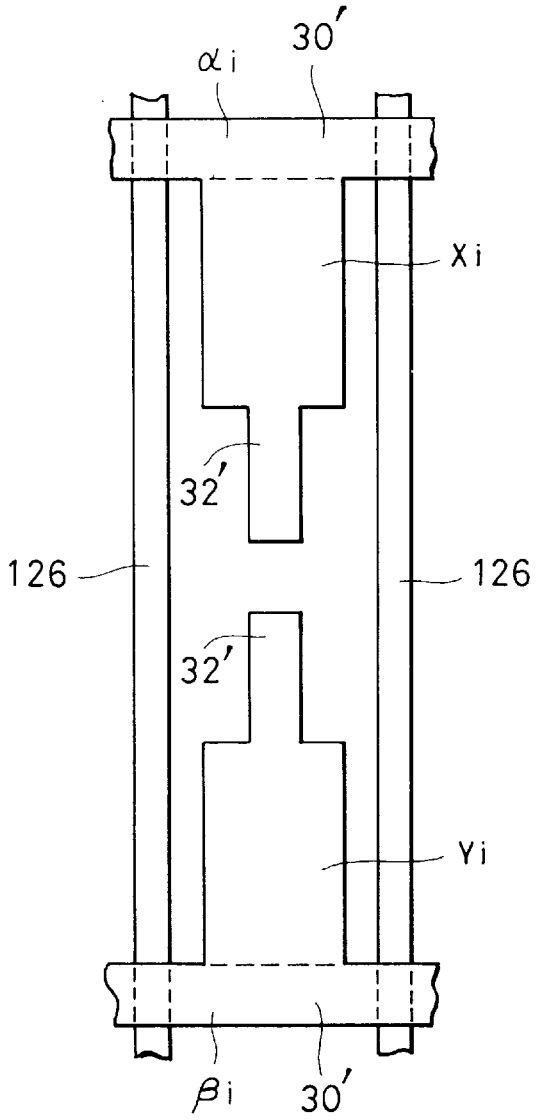
FIG. 10 is a top plan view of paired row electrodes of a fourth embodiment according to the present invention.

FIG. 10 illustrates a pair of row electrodes of a fourth embodiment according to the present invention, in which the configuration of the row electrodes is similar to that of FIG. 9. However, each of the row electrodes of FIG. 10 has a transparent electrode portion which faces a barrier rib 126 through the shortest distance and has the same width as that of a bus electrode. A plasma display apparatus employing the paired row electrodes illustrated in FIG. 10, therefore, produces the same effects as the plasma display apparatus employing the paired row electrodes illustrated in FIG. 9.

Figure 11:
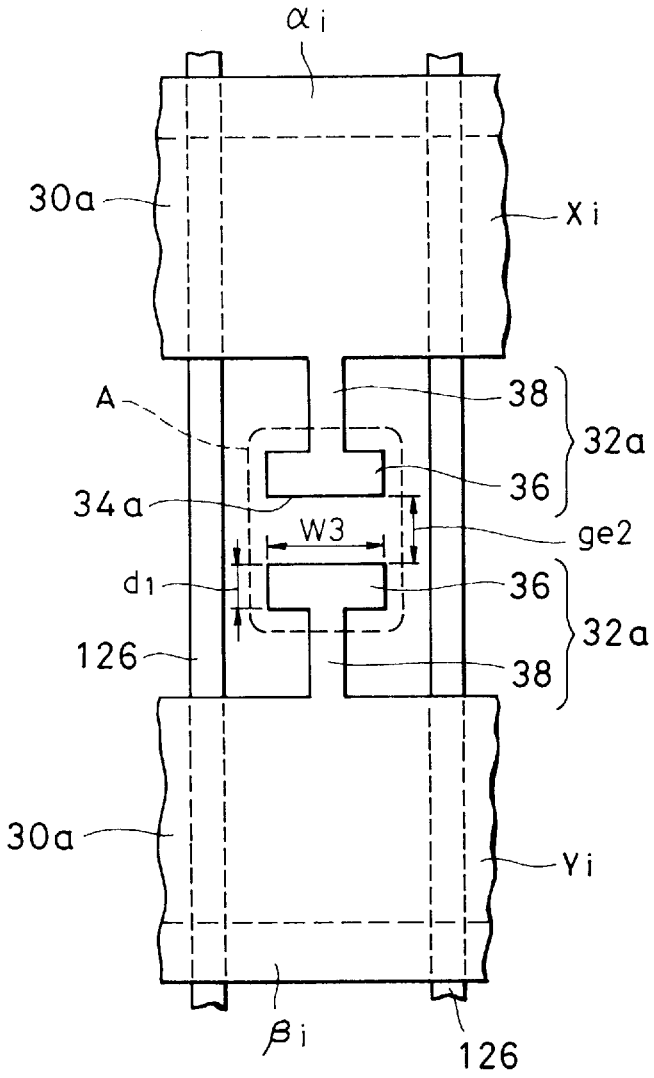
FIG. 11 is a top plan view of paired row electrodes of a fifth embodiment according to the present invention.

FIG. 11 illustrates the paired row electrodes Xi, Yi of a fourth embodiment according to the invention. Each row electrode Xi in the paired row electrodes Xi, Yi comprises a main body 30*a* extending in the longitudinal direction of the row electrode, and a projecting portion 32*a* projecting from the main body 30 in a direction intersecting with the extending direction of the main body 30*a* toward the other row electrode Yi which forms a pair therewith. Thus, the projecting portions 32*a* of both the row electrodes Xi, Yi project such that their ends 34*a* face each other through a predetermined gap 'ge2'. The predetermined gap 'ge2' serves as a discharge gap. Preferably, the projecting portion 32*a* projects in the direction perpendicular to the direction in which the main body 30*a* extends.

The projecting portion 32*a* of the row electrode Xi or Yi is formed with a wider portion 36 including the end 34*a* and a narrower portion 38 which joins the wider portion 36 with the main body 30*a* and has a width smaller than the width w3 of the end 34. In this embodiment, the wider portion 36 is formed such that the end 34*a* has the length w3 in a range of 200–250 μm, and the length d1 from the end 34*a* to the narrower portion 38 is in a range of 30–120 μm.

A plasma display apparatus employing the paired row electrodes having the structure illustrated in FIG. 11 is driven to emit light in a manner similar to the plasma display apparatus employing the paired row electrodes of the first embodiment. In driving the plasma display apparatus, when the reset pulse is reduced in voltage, pulse width, or the like to decrease the magnitude of a reset discharge during the initialization, a reset discharge region A is limited only within an area surrounded by a broken line in FIG. 11, i.e., near the discharge gap ge2 and the wider portions 36 even if the reset pulse fluctuates more or less in voltage or pulse width, so that a stable reset discharge can be realized substantially without any fluctuations in luminance of light emitted thereby. In addition, the reset discharge region A limited only near the discharge gap ge2 results in a reduced intensity of light emitted by the reset discharge, as compared with paired row electrodes without the narrower portions 38. In a sustaining discharge period, on the other hand, a discharge maintained region spreads over the entire electrodes to enable light to be emitted not only from the wider portions 36 but also from the entire row electrodes Xi, Yi, so that the plasma display apparatus employing the paired row electrodes of FIG. 11 improves the contrast of images displayed thereon.

It should be noted that the length d1 from the end 34*a* to the narrower portion 38 in the wider portion 36 being less than 30 μm is not appropriate because an extremely high accuracy is required for manufacturing such row electrodes, and disconnection is more likely to occur in such a narrow portion. In addition, the length d1 from the end 34*a* to the narrower portion 38 being more than 120 μm is not appropriate either for the dimension of the wider portion 36 because the wider portion 36 would have an excessively large area so that the reset discharge region would be extended to increase the intensity of light emitted by the reset discharge.

Further, since the reset discharge is limited only in the region A in the structure of the paired row electrodes Xi, Yi illustrated in FIG. 11, few wall charges will exist in row electrode portions nearer to bus electrodes αi, βi than the narrower portion 38 after the reset discharge, with the result that a higher wall charge density is provided in the wider portions 36 of the row electrodes after the reset discharge. It is therefore possible to ensure a larger potential difference between address electrodes, i.e., between a column electrode and a row electrode in a selective discharge for writing data into pixel cells. In addition, a stable selective discharge can be accomplished even if an applied data scan pulse has a lower voltage. Consequently, the voltage level of the data scan pulse can be reduced.

As alternative structures for the paired row electrodes producing the same effects as the paired row electrodes of FIG. 11, structures illustrated in FIGS. 12 to 16 may be considered.

Figure 12:
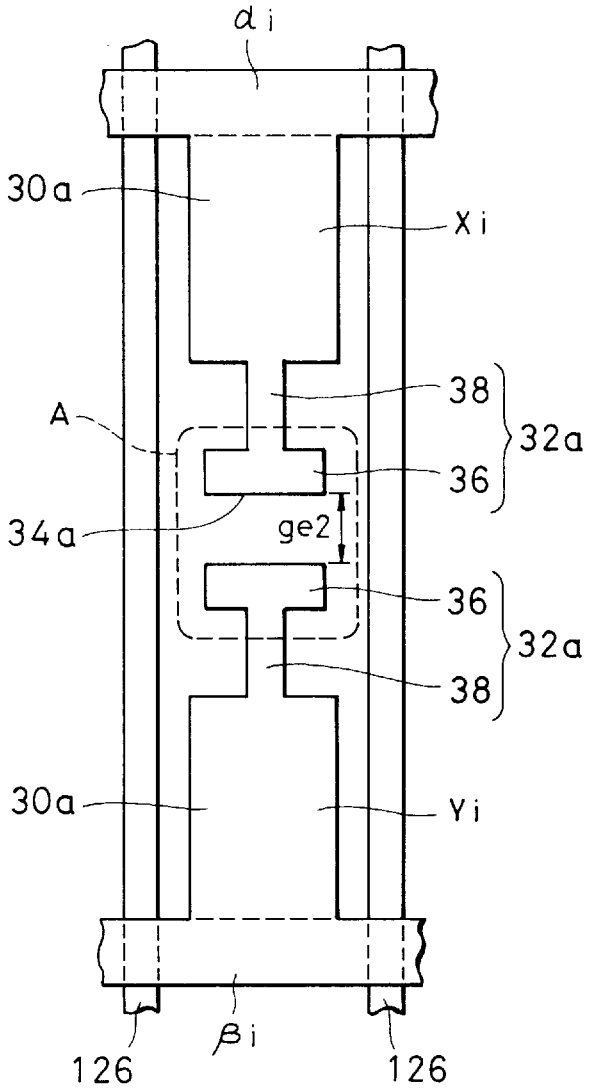
FIG. 12 is a top plan view of paired row electrodes of a sixth embodiment according to the present invention.

FIG. 12 illustrates a modification of the paired row electrodes Xi, Yi illustrated in FIG. 11, wherein each of the electrodes Xi, Yi has a transparent electrode portion formed with the same width as that of a bus electrode in a portion which faces a barrier rib 126 through an extremely short distance. The remaining structure in FIG. 12 is identical to FIG. 11. In the structure illustrated in FIG. 12, a reset discharge occurs only in a region including a discharge gap ge2 and wider portions 36, i.e., a limited region A surrounded by a broken like in FIG. 12.

Figure 13:
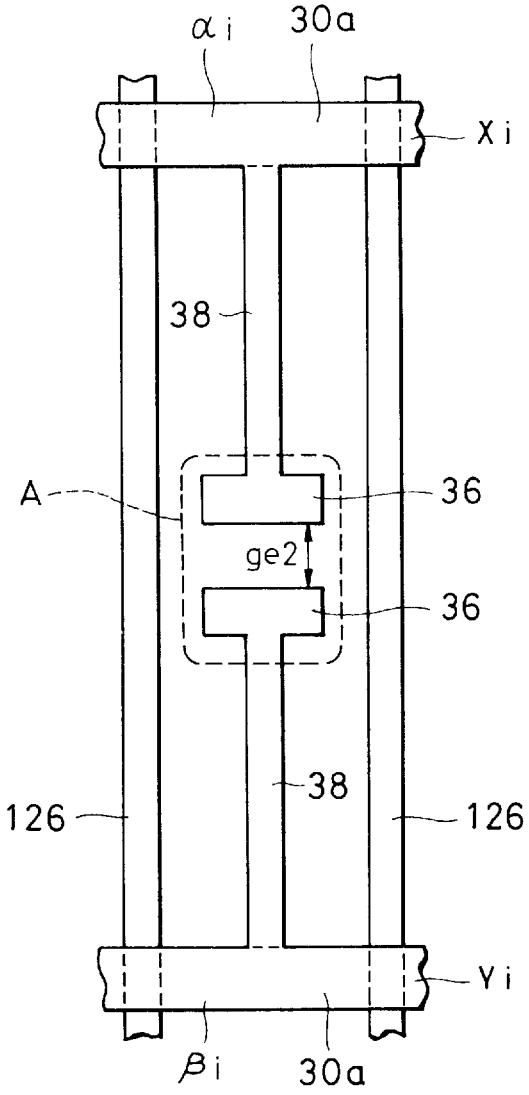
FIG. 13 is a top plan view of paired row electrodes of a seventh embodiment according to the present invention.

FIG. 13 illustrates a structure in which a main body 30*a* is formed in substantially the same width as and in an overlapping relationship with a bus electrode αi or βi, and a narrower portion 38 of a projecting portion 32*a* is formed to extend greatly in the longitudinal direction, as compared with the structure of FIG. 12. In the structure of FIG. 13, a reset discharge occurs only in a region including a discharge gap ge2 and wider portions 36, i.e., a limited region A surrounded by a broken line in FIG. 13.

Figure 14:
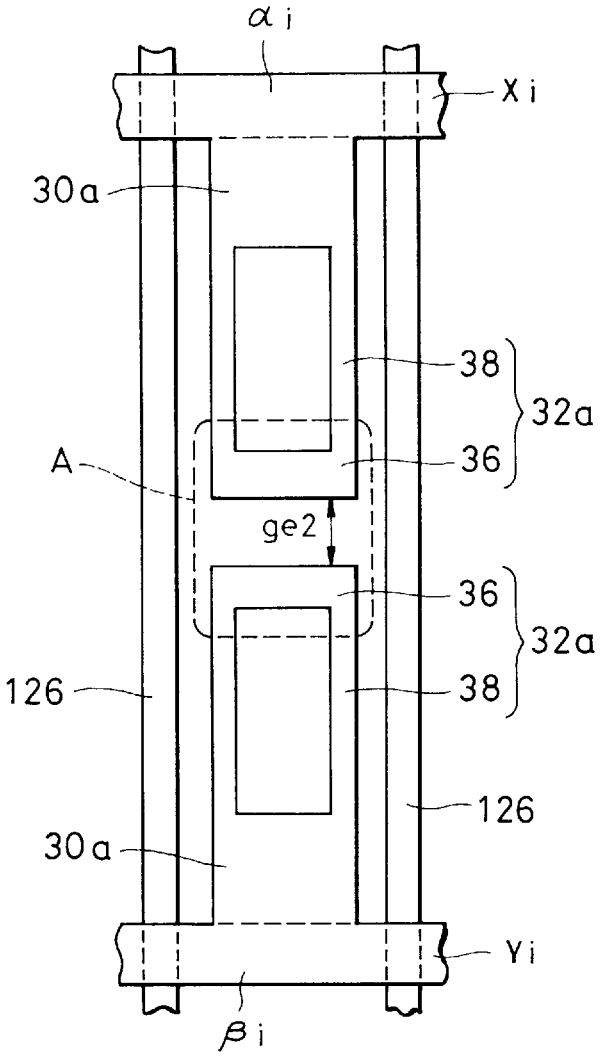
FIG. 14 is a top plan view of paired row electrodes of an eighth embodiment according to the present invention.

FIG. 14 illustrates a structure in which a projecting portion 32*a* has a narrower portion 38 divided into two in the longitudinal direction of the projecting portion 32*a* and joined to the upper and lower ends of a wider portion 36.

Figure 15:
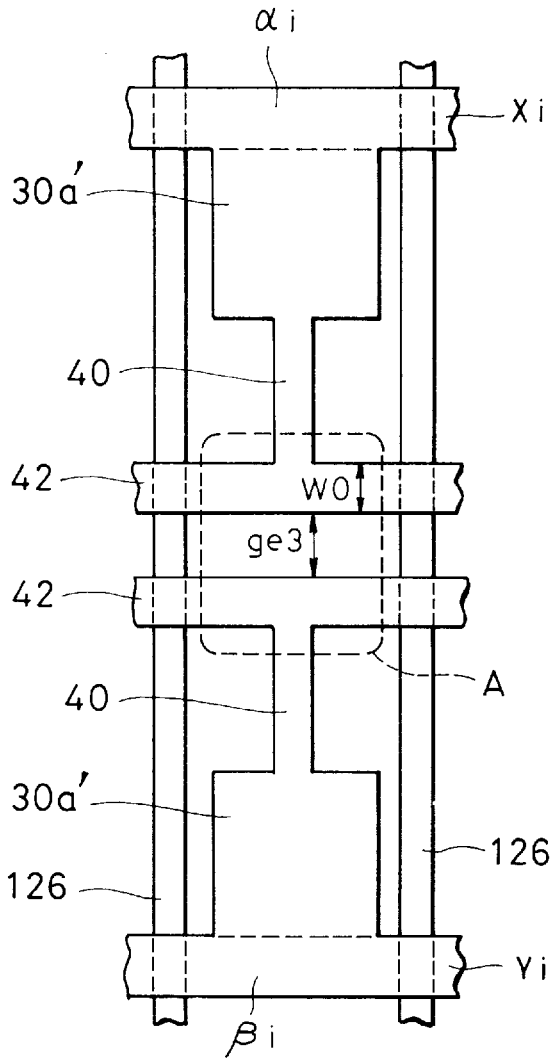
FIG. 15 is a top plan view of paired row electrodes of a ninth embodiment according to the present invention.

In paired row electrodes Xi, Yi illustrated in FIG. 15, each row electrode comprises a main body 30*a*' extending in a direction intersecting with a barrier rib 126 and having a width becoming smaller every time the main body 30*a* intersects with the barrier rib 126, a narrower portion 40 projecting from the main body 30*a*' toward the other row electrode in a direction substantially perpendicular to the longitudinal direction of the main body 30*a*', and an opposing end 42 joined to the narrower portion 40 at the end thereof and extending in a direction parallel to the main body 30*a*'. The opposing end 42 is continuous with an opposing end of an adjacent light emitting pixel region in the direction in which the paired row electrodes extend. A gap ge3 through which the opposing ends 42 of the paired row electrodes face each other serves as a discharge gap. The width w0 of the opposing end 42 ranges from 30 μm to 120 μm. A reset discharge occurs only in a limited region including a discharge gap ge3 and the opposing ends 42 in each pixel cell, i.e., a region A surrounded by a broken line in FIG. 15.

Figure 16:
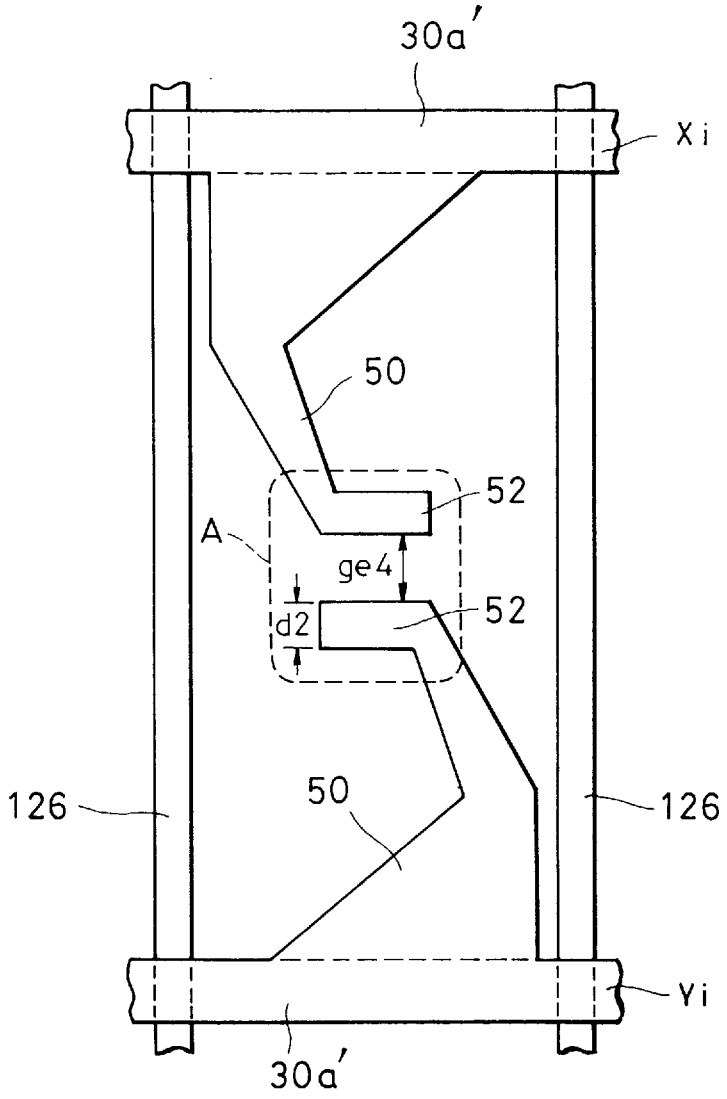
FIG. 16 is a top plan view of paired row electrodes of a tenth embodiment according to the present invention.

In paired row electrodes forming part of a single pixel cell illustrated in FIG. 16, a row electrode comprises a main body 30*a*' extending in the longitudinal direction of the row electrode, a connection 50 projecting from the main body 30*a*' and having a width gradually narrower as it projects farther away from the main body 30*a*', and a wider portion 52 joined to an end of the connection 50. The wider portion 50 has a width d2 ranging from 30 μm to 120 μm. In the structure illustrated in FIG. 16, a reset discharge occurs only in a limited region including a gap ge4 between the opposing wider portions 52 and the wider portions 52, i.e., a region A surrounded by a broken line in FIG. 16.

As described above in connection with the respective structures of the paired row electrodes illustrated in FIGS. 11–16, since a region associated with the reset discharge and the selective discharge, which are not related directly to display, is related to the sum of the area of the gap between the opposing wider portions and the area of the wider portions, the intensity of light emitted by the reset discharge and the selective discharge can be suppressed by reducing the sum of the areas and by providing the narrower portion 38 to prevent the discharge region from spreading.

In addition, the dielectric layer 130 is formed in a larger thickness near the discharge gap between the row electrodes Xi, Yi, while the dielectric layer 130 is formed in a smaller thickness adjacent to the bus electrodes αi, βi, irrespective of any structure of the paired row electrodes selected from those illustrated in FIGS. 2, and 8–16. In this case, if the reset discharge and the selective discharge are permitted to occur only near the discharge gap between the row electrodes during initialization and data write, the intensity of light emitted by the reset discharge and the selective discharge can be limited to a low level because of a low capacitance of the dielectric layer near the discharge gap.

Further, the dielectric coefficient of the dielectric layer 130 is made smaller near the discharge gap between the row electrodes, while the dielectric coefficient of the dielectric layer 130 is made larger adjacent to the bus electrodes αi, βi, irrespective of any structure of the paired row electrodes selected from those illustrated in FIGS. 2, and 8–16. Also in this case, if the reset discharge and the selective discharge are permitted to occur only near the discharge gap between the row electrodes during initialization and data write, the intensity of light emitted by the reset discharge and the selective discharge can be limited to a low level because of a low capacitance of the dielectric layer near the discharge gap.

It is understood that the foregoing description and accompanying drawings set forth the preferred embodiments of the invention at the present time. Various modifications, additions and alternative designs will, of course, become apparent to those skilled in the art in light of the foregoing teachings without departing from the spirit and scope of the disclosed invention. Thus, it should be appreciated that the invention is not limited to the disclosed embodiments but may be practiced within the full scope of the appended claims.

What is claimed is:

1. A method for indicating an image on a plasma display apparatus, said plasma display apparatus comprising a plurality of pairs of row electrodes each extending in parallel with each other, a plurality of column electrodes facing the plurality of pairs of row electrodes through a discharge space, said plurality of column electrodes extending in a direction orthogonal to the plurality of pairs of row electrodes, each of said column electrodes defining a unit light emitting region including an intersection formed every time one of the column electrodes crosses one of the pairs of row electrodes, and a dielectric layer covering said plurality of pairs of row electrodes, each of the row electrodes having a width of at least 300 μm in each unit light emitting region, said method comprising the steps of:

applying a first pre-discharge pulse to all of said plurality of pairs of row electrodes simultaneously to cause a pre-discharge between the pair of row electrodes;

applying a scan pulse to the pair of row electrodes and simultaneously applying a pixel data pulse to the column electrode to write pixel data in the corresponding unit light emitting region for any of the unit light emitting regions that are selected to emit light; and applying a series of sustaining discharge pulses alternately to each electrode of the pair of row electrodes to sustain the selected state for the pixel, wherein said first pre-discharge pulse has a pulse waveform whose leading edge rises more gradually as compared with that of the sustaining discharge pulses, such that the pre-discharge is limited only in a region around a discharge gap provided by a gap between the pair of row electrodes in the unit light emitting region.

2. A method according to claim 1, wherein the step of applying a first pre-discharge pulse to all of the plurality of pairs of row electrodes further includes the step of applying a second pre-discharge pulse to one row electrode in the pair immediately after the application of the first pre-discharge pulse.

3. A method according to claim 2, wherein the first pre-discharge pulse comprises a first sub-pulse having a predetermined polarity which is applied to one of the row electrodes in the pair and a second sub-pulse having a polarity opposite to that of the first sub-pulse, said second sub-pulse is simultaneously applied to the other row electrode in the pair, and wherein the second pre-discharge pulse consists of a pulse having the polarity opposite to that of the first sub-pulse.

4. A method according to claim 1, wherein said step of applying a scan pulse to the pair of row electrodes includes the step of applying a scan pulse to one of the row electrodes in the pair and simultaneously applying a pixel data pulse to the column electrode immediately after a priming pulse is applied to the other row electrode in the pair to cause a discharge between the pair of row electrodes.

5. A method according to claim 1, wherein in the step of applying a series of sustaining discharge pulses, a pulse width of the first applied sustaining discharge pulse is made longer than a pulse width of the next applied sustaining discharge pulse.

6. A method according to claim 1, further comprising the step of applying an erasure pulse to the pairs of row electrodes to erase pixel data written therein.

7. A method of driving a plasma display apparatus to display an image, said plasma display apparatus comprising a plurality of paired row electrodes each extending in parallel with each other, a plurality of column electrodes facing said plurality of pairs of row electrodes through a discharge space, said column electrodes extending in a direction orthogonal to said plurality of pairs of row electrodes, each of said column electrodes defining a unit light emitting region including an intersection formed every time one of the column electrodes crosses one of the pairs of row electrodes, and a dielectric layer covering the pairs of row electrodes, each of the pairs of row electrodes having projecting portions facing each other through a discharge gap in each unit light emitting region, said method comprising the steps of:

applying a first pre-discharge pulse to all of said plurality of pairs of row electrodes simultaneously to cause a pre-discharge between the pair of row electrodes;

applying a scan pulse to the pair of row electrodes and simultaneously applying a pixel data pulse to the column electrode to write pixel data in the corresponding unit light emitting region for any of the unit light emitting regions that are selected to emit light; and applying a series of sustaining discharge pulses alternately to each electrode of the pair of row electrodes to sustain the selected state for the pixel, wherein the first pre-discharge pulse has a pulse waveform whose leading edge rises more gradually as compared with that of the sustaining discharge pulse, such that the pre-discharge is limited only in a region around a discharge gap provided by a gap between the pair of row electrodes in the unit light emitting region.

8. A method according to claim 7, wherein said step of applying a first pre-discharge pulse to all of the paired row electrodes further includes the step of applying a second pre-discharge pulse to one row electrode in the pair immediately after the application of the first pre-discharge pulse.

9. A method according to claim 8, wherein said first pre-discharge pulse comprises a first sub-pulse having a predetermined polarity which is applied to one of the row electrodes in the pair and a second sub-pulse having a polarity opposite to that of the first sub-pulse, said second sub-pulse is simultaneously applied to the other row electrode in the pair, and said second pre-discharge pulse consists of a pulse having the polarity opposite to that of the first sub-pulse.

10. A method according to claim 7, wherein said step of applying a series of scan pulses to the pair of row electrodes includes the step of applying a scan pulse to one of the row electrodes in the pair and simultaneously applying a pixel data pulse to the column electrode immediately after a priming pulse is applied to the other row electrode in the pair to cause a discharge between the pair of row electrodes.

11. A method according to claim 7, wherein in the step of applying a series of sustaining discharge pulses, a pulse width of the first applied sustaining discharge pulse is made longer than a pulse width of the next applied sustaining discharge pulse.

12. A method according to claim 7, further comprising the step of applying an erasure pulse to the pairs of row electrodes to erase pixel data written therein.

* * * * *